US008607864B2

(12) United States Patent
Mcleod et al.

(10) Patent No.: US 8,607,864 B2
(45) Date of Patent: Dec. 17, 2013

(54) LIVE BOTTOM HOLE PRESSURE FOR PERFORATION/FRACTURING OPERATIONS

(75) Inventors: Trevor Mcleod, Calgary (CA); Abbas Mahdi, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 160 days.

(21) Appl. No.: 12/039,583

(22) Filed: Feb. 28, 2008

(65) Prior Publication Data

US 2009/0218094 A1 Sep. 3, 2009

(51) Int. Cl.

| | |
|---|---|
| ***E21B 43/26*** | (2006.01) |
| ***E21B 49/00*** | (2006.01) |
| ***E21B 47/06*** | (2012.01) |
| ***G05D 7/06*** | (2006.01) |

(52) U.S. Cl.
USPC ..... 166/250.1; 166/308.1; 73/152.51; 700/283

(58) Field of Classification Search
USPC ..... 166/250.1, 308.1, 297, 299, 55, 63, 166/177.5
See application file for complete search history.

(56) References Cited

U.S. PATENT DOCUMENTS

| | | | | |
|---|---|---|---|---|
| 6,186,230 | B1 * | 2/2001 | Nierode | 166/250.1 |
| 6,543,538 | B2 * | 4/2003 | Tolman et al. | 166/284 |
| 6,837,310 | B2 | 1/2005 | Martin | |
| 6,978,831 | B2 * | 12/2005 | Nguyen | 166/250.01 |
| 7,385,523 | B2 | 6/2008 | Thomeer et al. | |
| 2002/0050930 | A1 | 5/2002 | Thomeer et al. | |
| 2004/0112591 | A1 | 6/2004 | Wright et al. | |
| 2005/0178551 | A1 * | 8/2005 | Tolman et al. | 166/297 |
| 2005/0263281 | A1 * | 12/2005 | Lovell et al. | 166/255.1 |
| 2007/0062708 | A1 | 3/2007 | McGregor et al. | |
| 2007/0151735 | A1 | 7/2007 | Ravensbergen et al. | |
| 2007/0193740 | A1 * | 8/2007 | Quint | 166/250.07 |
| 2007/0215345 | A1 * | 9/2007 | Lafferty et al. | 166/250.1 |
| 2007/0227735 | A1 | 10/2007 | Rytlewski | |
| 2008/0066535 | A1 | 3/2008 | Vasques et al. | |

FOREIGN PATENT DOCUMENTS

| | | |
|---|---|---|
| EP | 0694157 | 1/1996 |

* cited by examiner

*Primary Examiner* — Kenneth L Thompson
*Assistant Examiner* — James Sayre
(74) *Attorney, Agent, or Firm* — Myron K. Stout; Daryl R. Wright

(57) ABSTRACT

A method of determining when to stop pumping proppant during hydraulic fracturing in a wellbore is described. By accurately detecting tip screen-out with a bottom hole pressure gauge mounted to a perforating gun, the optimal amount of proppant can be supplied to a fracture while avoiding the risks associated with wellbore screen-out.

18 Claims, 6 Drawing Sheets

LIVE BOTTOM HOLE PRESSURE FOR PERFORATION/FRACTURING OPERATIONS

TECHNICAL FIELD

The present invention relates generally to pressure measurement in a wellbore. More specifically, the invention relates to real time pressure measurement in a wellbore during fracturing operations to better detect screen-out.

BACKGROUND OF THE INVENTION

The statements in this section merely provide background information related to the present disclosure and may not constitute prior art.

Hydraulic fracturing is a process whereby a subterranean hydrocarbon reservoir is stimulated to induce a highly conductive path to the formation, increasing the flow of hydrocarbons from the reservoir. A fracturing fluid is pumped at high pressure to crack the formation, creating larger passageways for hydrocarbon flow. The fracturing fluid may include a proppant, such as sand or other solids that fill the cracks in the formation, so that, when the fracturing treatment is done and the high pressure is released, the fracture remains open.

Key to a successful fracturing operation is the accurate monitoring of the bottom hole pressure in the wellbore, and determining when to stop pumping fracturing fluid and initiate flush of the wellbore. Early initiation of the flush results in less than optimal fracturing of the hydrocarbon bearing formation and a less productive well. However, surface pressure measurements are prone to result in just such early initiation of the flush. This is because the pressure at the surface does not accurately reflect the conditions at the bottom of the wellbore. In particular, surface measurements include additional effects such as the friction of the flowing slurry along the length of the wellbore or the constantly changing hydrostatic pressure of the proppant laden fracturing fluid. Modeling these effects is typically not accurate enough to determine precisely when to initiate the flush based upon the surface pressure. On the other hand, if the flush is initiated too late, the pumping of additional slurry leads to wellbore screen-out, where the proppant backs up into, and fills the wellbore.

Wellbore screen-out is undesirable because the proppant restricts the free flow of hydrocarbons in the wellbore and, in the extreme, can trap downhole assemblies in the wellbore. If the wellbore screen-out is significant enough, the entire process of perforation and fracturing must be stopped while wellbore repair is performed. During repair, the overpressure is released, permitting ball sealers, put in place after previous fracture treatments, to fall out, and precluding further fracturing after the repair is completed, without the placement of additional wellbore plugs. Therefore, repair of a wellbore after a wellbore screen-out is expensive and time consuming.

From the foregoing it will be apparent that there remains a need to measure bottom hole pressure during fracturing operations to accurately detect tip screen-out and prevent wellbore screen-out.

SUMMARY OF INVENTION

Some embodiments of the invention are methods of operating a perforating gun system in a wellbore penetrating a subterranean formation, using a system comprising an array of perforating guns and a sensor package adjacent the array of perforating guns. These methods may generally comprise at least placing the perforating gun system proximate a treatment zone in the wellbore; measuring at least one parameter in the wellbore with the sensor package; transmitting the measurement of the at least one parameter to a monitoring and controlling system; and adjusting at least one operational parameter of the perforating gun system in response to the transmitted measurement to achieve improved treatment efficiency and reservoir optimization.

In another aspect, methods for fracturing a subterranean formation penetrated by a wellbore are disclosed. These methods comprise conveying a perforating gun system through the wellbore to a treatment zone wherein the system comprises an array of perforating guns and a sensor package adjacent the array of perforating guns, introducing a fracturing fluid into the wellbore at a pressure sufficient to fracture the formation, measuring at least one parameter in the wellbore with the sensor package, transmitting the measurement of the at least one parameter to a monitoring and controlling system, and adjusting at least one operational parameter of the perforating gun system in response to the transmitted measurement.

In yet another aspect, the invention is a method of treating a subterranean formation penetrated by a wellbore comprising conveying a perforating gun system through the wellbore to a treatment zone wherein the system comprises an array of perforating guns and a sensor package adjacent the array of perforating guns, measuring at least one parameter in the wellbore with the sensor package, and adjusting on a real time basis at least one operational parameter in response to the measurement The sensor packages used in accordance with the invention may comprise one or more of a pressure sensor, temperature sensor, pH sensor, or any combination thereof, while the parameters measured are at least one or more of pressure, temperature, or pH. Of course, any other suitable sensor or sensed parameter may be used as well. Preferably the sensor is a pressure sensor used for measuring pressure. When pressure is measured, in response to measured pressure a sudden buildup in pressure in the wellbore at the location of the perforating gun system during the operation wherein a proppant is being pumped into a formation adjacent to the wellbore may be detected; and in response to the detection of a sudden buildup in pressure in the wellbore, a flushing operation may be commenced in the wellbore, thereby removing excess proppant from the wellbore and preventing the wellbore from filling with excess proppant. Also, the sudden buildup of pressure that causes the flushing operation may be such that, when the pressure measurement is plotted against time on a Nolte-Smith Plot, the slope of the pressure measurement exceeds one (1.0).

Embodiments of the invention may also include moving the perforating gun system, and repeating at least one of the placing, measuring, transmitting and adjusting steps.

Monitoring and controlling system may comprise surface equipment to make the measurement transmitted readable by one or more of a computer or operator. Alternatively, the monitoring and controlling system comprises equipment to make the measurement transmitted readable by a computer located in the wellbore. Also, the monitoring and controlling system may comprises equipment to make the measurement transmitted readable by one or more of a computer or operator, wherein the equipment is located in the wellbore and at the surface. The monitoring and controlling system may comprise at least one or more of a data transmitting means, a computer, and a general user interface In some aspects of the invention, the measuring of at least one parameter, transmitting of the measurement of the at least one parameter, and the adjusting of at least one operational parameter may be conducted on a real time basis. Any suitable and/or readily known operational parameter to one of skill in the art may be adjusted, including treatment fluid components, treatment fluid flow rate, treatment fluid pressure, or treatment fluid properties, or any combination thereof. Fluids introduced into the wellbore include pad fracturing fluids, proppant laden fluids, flushes stage, prepad fluids, cleanout fluids, acidizing fluids, and the like. The fluids may be injected at any suitable pressure, including pressures equal to, below, or above the fracturing initiation pressure of the formation penetrated by the wellbore. In some cases, the fluids are at least partially injected prior to the measuring at least one parameter.

In accordance with the invention, the perforating gun system may be conveyed by any suitable conveyance system including wireline, tractor, coiled tubing jointed tubing, and the like.

DETAILED DESCRIPTION OF THE INVENTION

Figure 1:
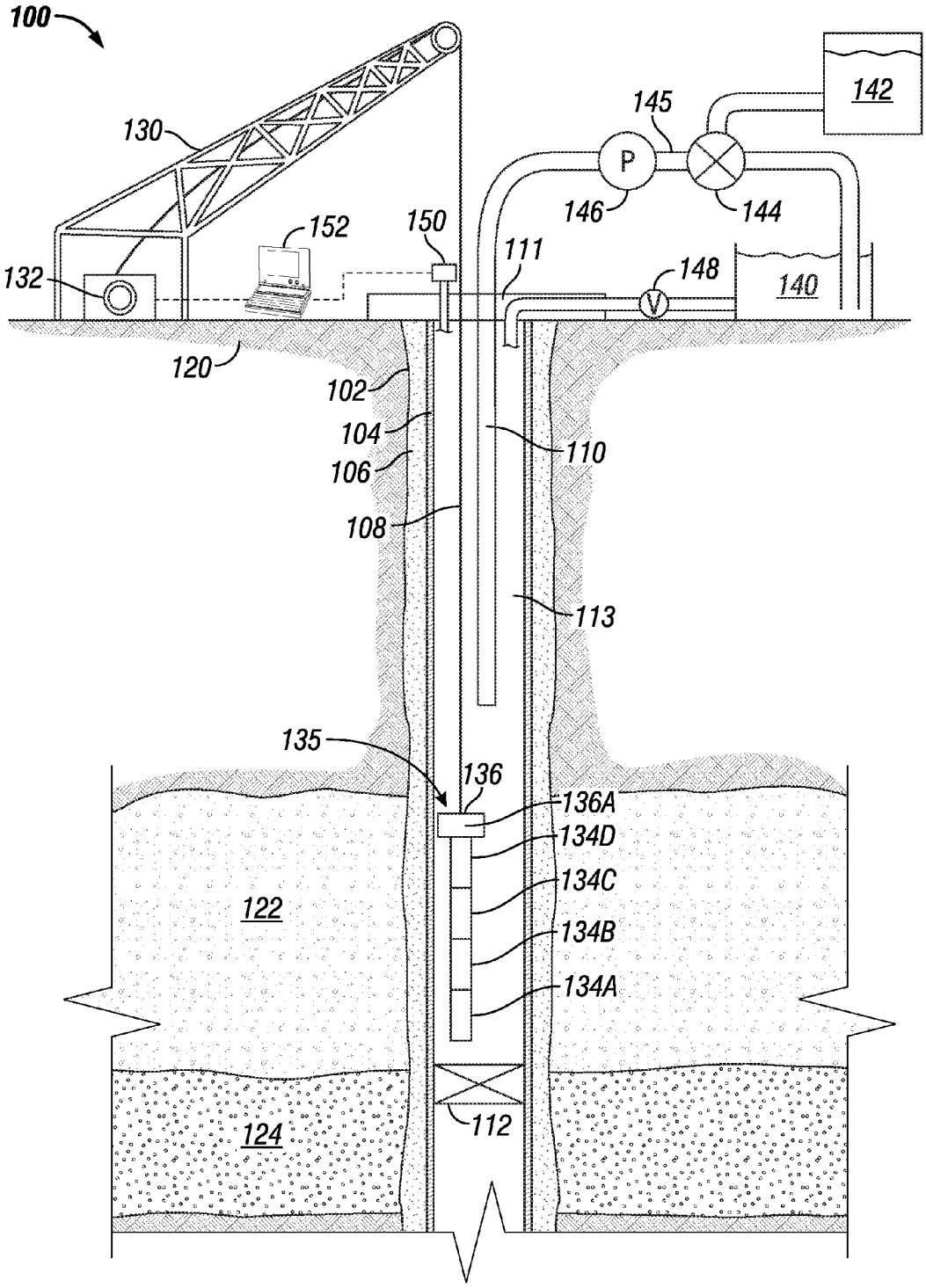
FIG. 1 illustrates a wellbore with the associated perforation and hydraulic fracturing equipment.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

It should also be noted that in the development of any such actual embodiment, numerous decisions specific to circumstance must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Disclosed herein is a method of measuring bottom hole pressure during perforation/hydraulic fracturing (perf/frac) operations, and using the bottom hole pressure profile to determine when to stop pumping proppant laden fracturing fluid and initiate the flush of the wellbore. In some aspects, the invention relates to real time pressure measurement in a wellbore during fracturing operations to better detect screen-out.

Hydraulic fracturing is a process whereby a subterranean hydrocarbon reservoir is stimulated to increase the permeability of the formation, increasing the flow of hydrocarbons from the reservoir. A fracturing fluid is pumped at high pressure to crack the formation, creating larger passageways for hydrocarbon flow. The fracturing fluid includes a proppant, such as sand or other solids that fill the cracks in the formation, so that, when the fracturing treatment is done and the high pressure is released, the cracks do not just close up (i.e., the cracks remain propped open).

FIG. 1 illustrates a perforation/hydraulic fracturing operation, depicted generally as 100. A wellbore 102 is drilled through an overburden layer 120, through a productive formation 122, and further into the underlying formation 124. Casing 104 is placed into the wellbore 102 and the annulus between the wellbore 102 and the casing 104 is filled with cement 106. To this point, the productive zone 122 is isolated from the well 113, the area within the casing. The productive zone 122 is further isolated from the underlying formation 124 by a plug 112. A tubing string 110 runs from the surface through the wellbore cap 111 into the well 113 in the productive zone 122.

Figure 2:
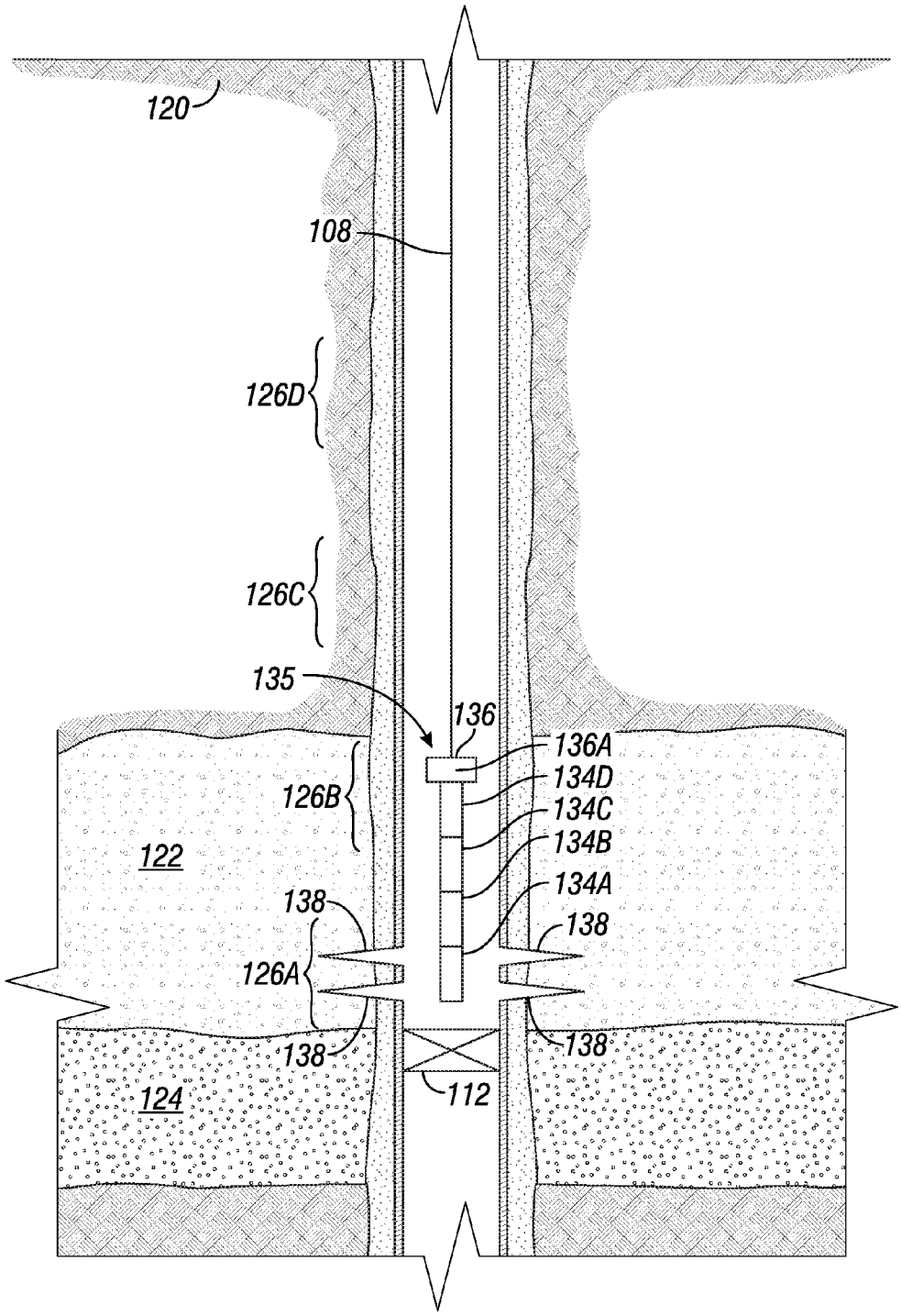
FIG. 2 shows a wellbore with a perforating gun in place in a fracture treatment zone with perforations made in the wellbore casing.
Figure 3:
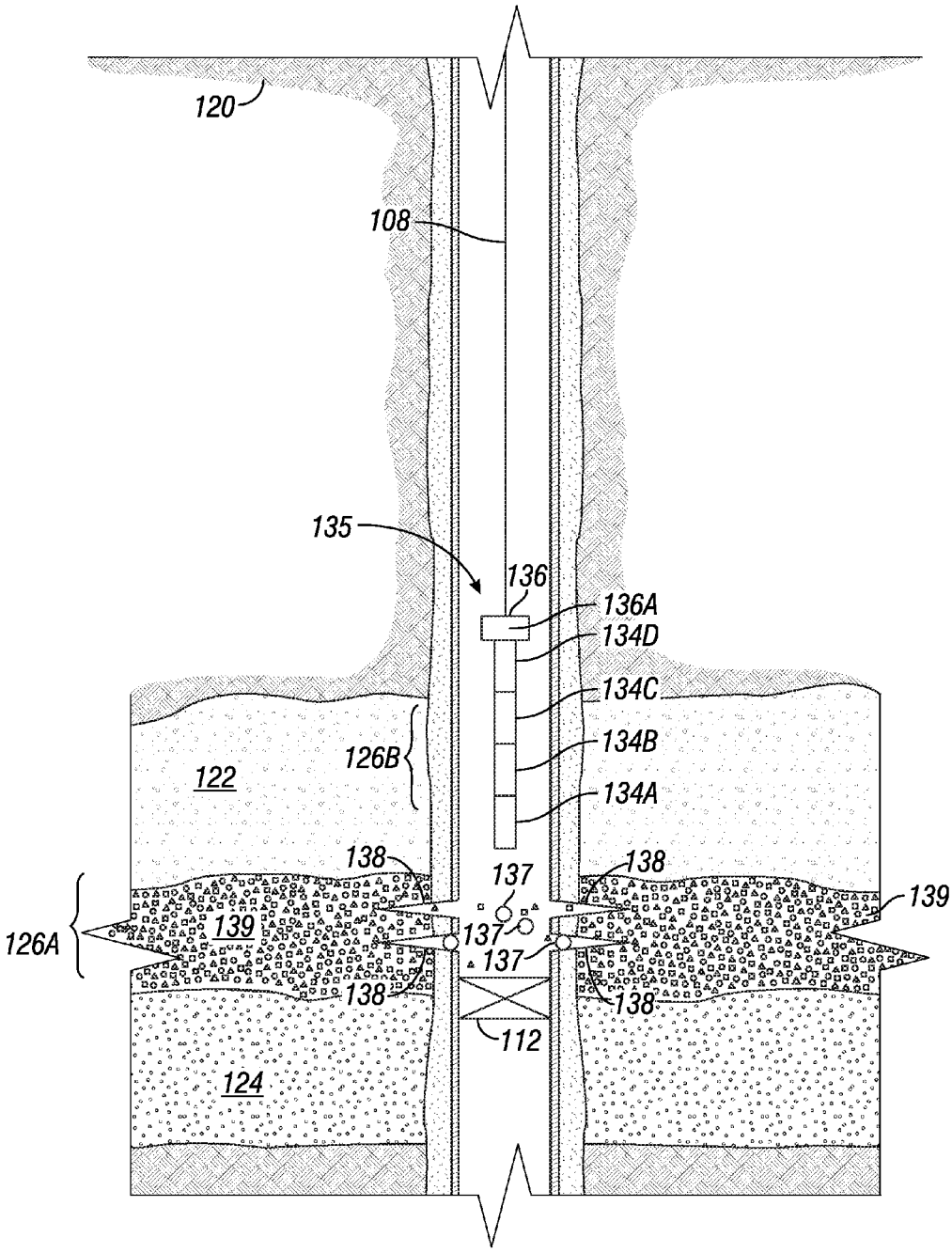
FIG. 3 shows the wellbore of FIG. 2 with the perforating gun moved and the hydraulic fracturing completed.

As noted above, the productive zone 120 is isolated from the well 113 by the casing 104 and the cement 106. Therefore, before any fracturing operations or production can commence, the casing 104 and the cement 106 have to be perforated. The perforating gun 135 is a device that has several shaped charges 134A, 134B, 134C and 134D. The perforating gun 135 is lowered into the well 113 on a wireline 108 by the perforating rig 130 and the perforating rig winch 132 to the first fracture treatment zone 126A. The perforating gun 135 is connected by the wireline 108 to a monitoring and control computer 152 that controls the triggering of the individual shaped charges 134A, 134B, 134C or 134D. The monitoring and control computer 150 also monitors inputs from a perforating gun sensor package 136 and from a surface sensor package 150 during the perforation/hydraulic fracturing operation. When the first set of shaped charges 134A is proximate to the first fracture treatment zone 126A, as shown in FIG. 2, the monitoring and control computer 150 triggers the first set of shaped charges 134A. The first set of shaped charges 134A then emit streams of super hot gas which burns holes 138, called perforations, through the casing 104 and the cement 106, and into the fracture treatment zone 126A, opening up access to the hydrocarbons in the productive zone 122. The perforating gun 135 is then lifted out of the way of the perforations 138 to the second fracture treatment zone 126B by the perforating rig 130 and the perforating rig winch 132, and the fracturing operation commences, as illustrated in FIG. 3.

The perforations 138 permit only limited communication of hydrocarbons from the productive formation 122 into the well 113. In order to improve the flow of hydrocarbons from the productive formation 122, a fracturing fluid 140 is combined with a proppant 142 in a mixer 144 to form a slurry 145. The proppant 142 is any suitable proppant may be used, provided that it is compatible with the formation, the slurry, and the desired results. Such proppants (gravels) can be natural or synthetic, coated, or contain chemicals; more than one can be used sequentially or in mixtures of different sizes or different materials. Proppants and gravels in the same or different wells or treatments can be the same material and/or the same size as one another and the term "proppant" is intended to include gravel in this discussion. In general the proppant used will have an average particle size of from about 0.15 mm to about 2.5 mm, more particularly, but not limited to typical size ranges of about 0.25-0.43 mm, 0.43-0.85 mm, 0.85-1.18 mm, 1.18-1.70 mm, and 1.70-2.36 mm. Normally the proppant will be present in the slurry in a concentration of from about 0.12 kg proppant added to each L of carrier fluid to about 3 kg proppant added to each L of carrier fluid, preferably from about 0.12 kg proppant added to each L of carrier fluid to about 1.5 kg proppant added to each L of carrier fluid.

Preferably, the proppant materials include, but are not limited to, sand, resin-coated sand, zirconia, sintered bauxite, glass beads, ceramic materials, naturally occurring materials, or similar materials. Mixtures of proppants can be used as well. Naturally occurring materials may be underived and/or unprocessed naturally occurring materials, as well as materials based on naturally occurring materials that have been processed and/or derived. Suitable examples of naturally occurring particulate materials for use as proppants include, but are not necessarily limited to: ground or crushed shells of nuts such as walnut, coconut, pecan, almond, ivory nut, brazil nut, etc.; ground or crushed seed shells (including fruit pits) of seeds of fruits such as plum, olive, peach, cherry, apricot, etc.; ground or crushed seed shells of other plants such as maize (e.g., corn cobs or corn kernels), etc.; processed wood materials such as those derived from woods such as oak, hickory, walnut, poplar, mahogany, etc., including such woods that have been processed by grinding, chipping, or other form of particalization, processing, etc, some nonlimiting examples of which are proppants supplied under the tradename LiteProp™ available from BJ Services Co., made of walnut hulls impregnated and encapsulated with resins. Further information on some of the above-noted compositions thereof may be found in Encyclopedia of Chemical Technology, Edited by Raymond E. Kirk and Donald F. Othmer, Third Edition, John Wiley & Sons, Volume 16, pages 248-273 (entitled "Nuts"), Copyright 1981, which is incorporated herein by reference.

The slurry 145 is pumped through the tubing string 110 by the pump 146 and forced through the perforations 138 and on into the productive formation 122, forming cracks or fractures 139 in the productive formation 122. The proppant 142 in the slurry 145 is wedged into the fractures 139, holding the fractures 139 open after pumping stops. In this way, the fractures 139 filled with proppant 142 form a permeable conduit for the continued flow of hydrocarbons from the productive formation 122 to the well 113.

A method of perforation/hydraulic fracturing is described in U.S. Pat. No. 6,543,538, to Tolman, et al., (Method for treating multiple wellbore intervals), which is hereby incorporated by reference. Described therein is a perforating gun 135 with four "select-fire perforation charge carrier[s]" 134A, 134B, 134C and 134D, that can be independently fired. The method described begins by perforating 138 the wellbore 102 at the first fracture treatment zone 126A, and then moving the perforating gun 135 to the second fracture treatment zone 126B. Next, the slurry 145 is pumped in to the perforations 138, cracking the formation 122 and setting the proppant in the cracks. When the fracturing is completed, a method of isolation is employed to prevent any further treatment of the completed zone. Several examples of isolation are described, including ball sealers 137 and mechanical flapper valves (not shown). In either case, the process is then repeated, starting with perforating the wellbore at the second, third, fourth, or any suitable number of fracture treatment zones 126B, 126C and 126D, with no necessary limitation on the number of treatment zone. This method permits perforation and fracturing operations to proceed in one continuous process, without having to remove equipment from the wellbore 102 after each step. This method also permits a constant overpressure to be applied to the wellbore to hold ball sealers 137 in place, as is known in the art.

More particularly, hydraulic fracturing operations typically consist of mixing various chemicals (not shown) and proppants 142 into a fracturing fluid 140 and pumping the slurry 145 into a hydrocarbon bearing formation 122 to crack the formation 139 and wedge the proppant 142 into the cracks 139. The pumping occurs in three stages. First, a pad is pumped into the formation to initiate the fracturing of the formation and to buffer the formation against excessive fluid leak-off. The pad does not contain proppants. Next, the slurry 145 is pumped into the productive formation 122. Finally, when the productive formation 122 can accept no more proppant 142, the mixing 144 of fracturing fluid 140 and proppant 142 is halted, but pumping of the fracturing fluid 140 alone continues and a fluid return valve 148 on the surface is opened, permitting circulation of fracturing fluid 140 to flush the wellbore 102.

Figure 4:
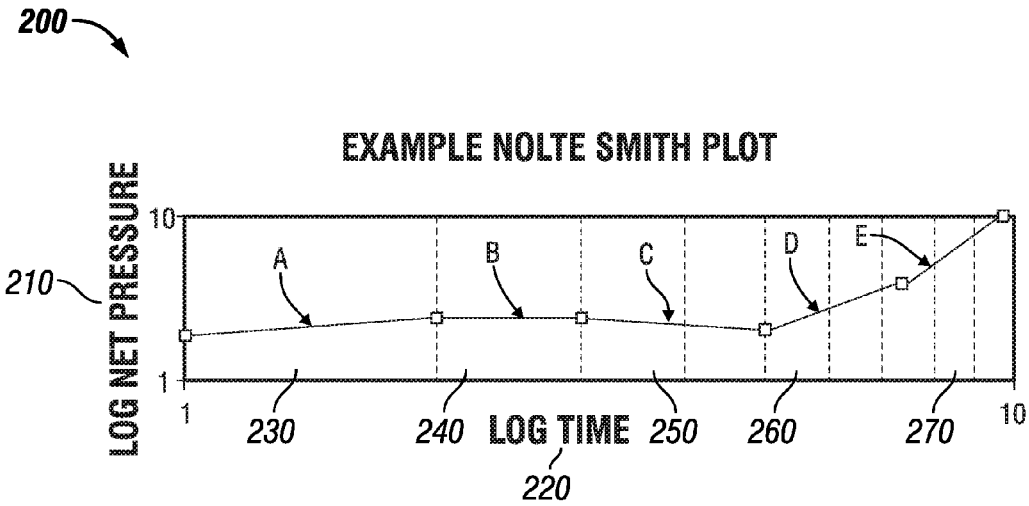
FIG. 4 is an example of a Nolte-Smith plot.

During hydraulic fracturing, the pressure in the wellbore is closely monitored. The pressure is typically plotted on, but not limited to, a Nolte-Smith plot 200, shown in FIG. 4, which plots the logarithm of net pressure 210 versus the logarithm of time 220. Formation characteristics and fluid friction combine to limit the effective length of a given fracture. The ideal Nolte-Smith plot 200 reflects the pressure in the wellbore 102 at the fracture treatment zone 126. Here, an increase in net pressure with a slope of less than 1.0 230 indicates that the fracture has a confined height and unrestricted propagation. A slope at or near 0.0 (zero) 240 can indicate restricted height growth with reduced propagation of the fracture, or, if a critical net pressure has been reached, it can indicate the opening of natural fissures in the productive formation 122 which cause greater leak-off of fracturing fluid. A negative slope 240 indicates unrestricted height growth. A slope of 1.0 260 indicates that propagation of the fracture has ceased near the tip of the fracture, a condition known as tip screen-out. A slope of greater than 1.0 270 indicates that the fracture is no longer accepting proppant 142.

Figure 5:
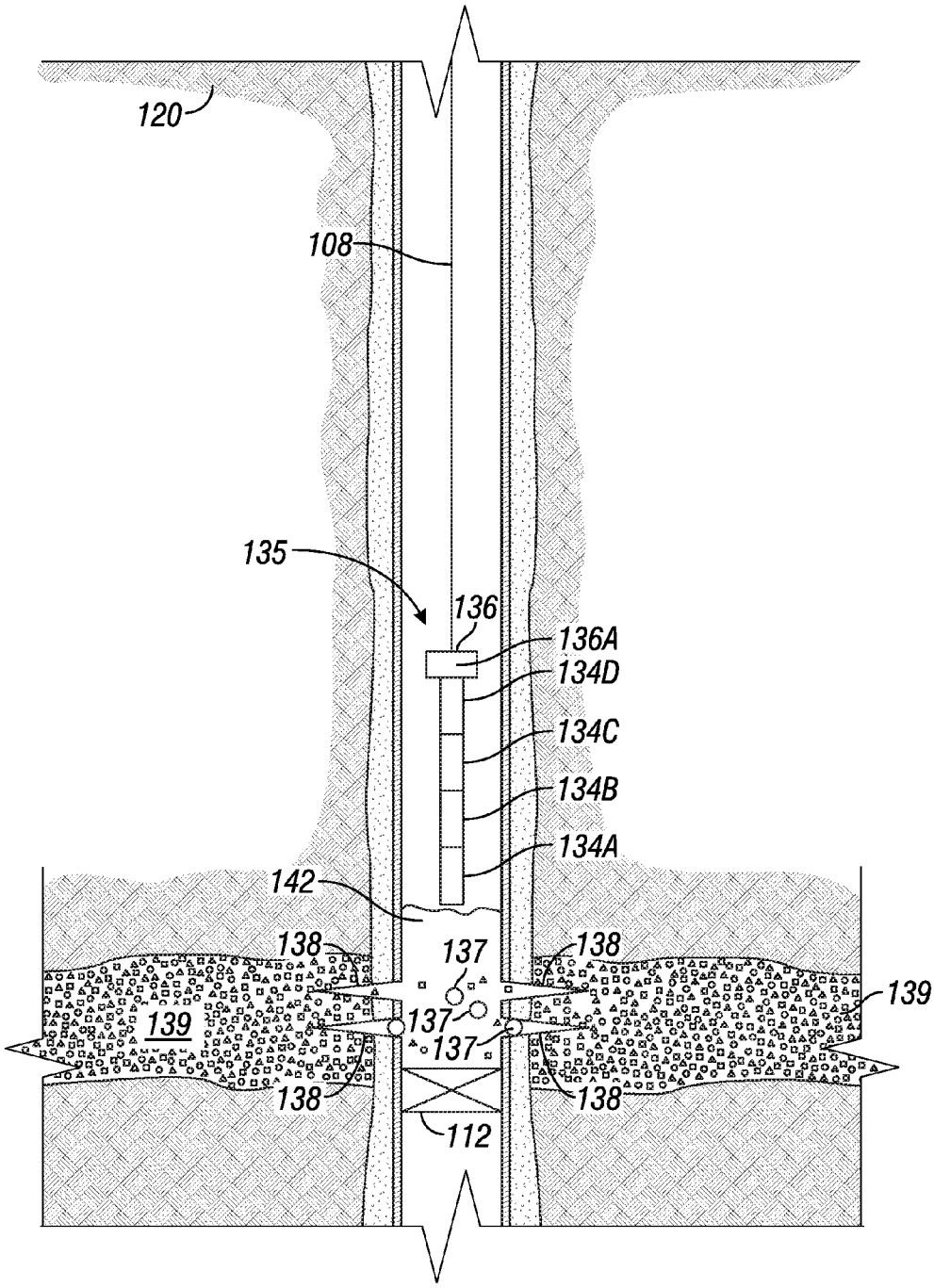
FIG. 5 shows the wellbore of FIG. 3 with partial wellbore screen-out.
Figure 6:
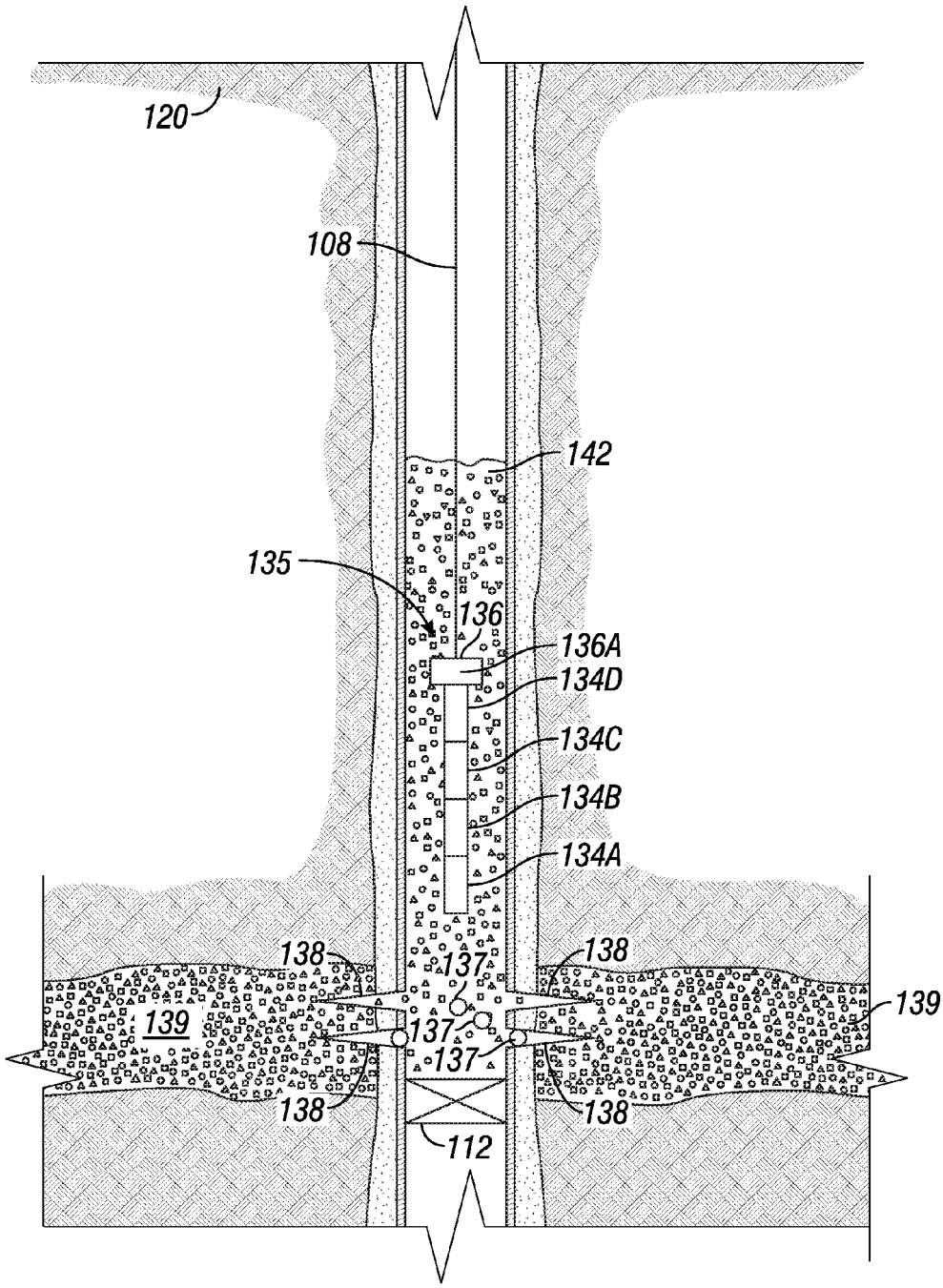
FIG. 6 shows the wellbore of FIG. 5 with complete wellbore screen-out.

The pressure in the wellbore is typically measured at the surface by the surface sensor package 150 and monitored by the monitoring and control computer 152. While the pressure, as plotted on the Nolte-Smith plot 200 is used to approximate the conditions in the fracture treatment zone 126, the actual pressure measured by the surface sensor package 150 is not an accurate measure of the pressure in the fracture treatment zone 126. In particular, the pressure as measured by the surface sensor package 150 has to be adjusted to compensate for the fluid friction of the fracturing fluid 140 flowing through the tubing string 110 and the casing 104, the hydrostatic pressure of the column of slurry 145 in the wellbore 102, and for the density of the slurry 145, among other factors. Modeling for these effects is not typically accurate enough to determine precisely when tip screen-out occurs. However, accurate detection of tip screen-out is required for successful hydraulic fracturing operations. Early initiation of the flush results in less than optimal fracturing of the productive formation 122 and ultimately to a less productive well 113. Of greater concern is the result of initiating the flush to late. As shown in FIG. 5, when the flush is delayed after tip screen-out, the pumping of additional slurry 145 leads to wellbore screen-out, a condition where the excess proppant 142 backs up into and fills the wellbore 102. When the excess proppant 142 obstructs the perforations 138, the flow of hydrocarbons from the productive formation 122 is restricted and pumping efficiency is limited. If the estimate of the onset of tip screen-out, as detected by the surface sensor package 150 is highly inaccurate, the wellbore screen-out can be extreme, as shown in FIG. 6. Here, the excess proppant 142 not only obstructs the perforations 138, but also buries the perforating gun 135. In this case, the perforation/hydraulic fracturing operation must be ceased to fish out the perforating gun 135, pump out the excess proppant 142 and restart the perforation/hydraulic fracturing operation. Such fishing operations are not only costly, but also, they present a potential safety hazard if the perforating gun 135 has unfired charge carriers 134. The situation is further complicated if ball sealers 137 are used to isolate the fracture treatment zones 126, because, in normal operation, the ball sealers 137 are held into their respective perforations 138 by the constant application of over-pressure on the wellbore 102. The over-pressure must be released to fish out the perforating gun 135 and pump out the excess proppant 142, and so the ball sealers fall out of their respective perforations 138, precluding subsequent perforation/hydraulic fracturing operations on the wellbore 102.

Perforating gun sensor package 136 may include a pressure sensor, pressure gauge, temperature gauge, temperature sensor, pH sensor, or any combination thereof, to measure conditions during the course of the treatment, transmit such measurement(s) to a monitoring and control computer, for real time adjustment of the treatment (i.e. fracturing treatment). As used herein, the term "real time adjustment" means measuring a downhole parameter (i.e. pressure, temperature, pH, etc.), transmitting the measurement to a monitoring system, analyzing and adjusting controllable parameters in the course of treatment, all in order to achieve treatment efficiency and reservoir optimization, and in one embodiment, particularly by detecting a screen out event, or even an upcoming screenout event. The monitoring equipment may be at the surface, or located in the wellbore. The monitoring system may comprise a computer, an operator, or both, or any other suitable means for monitoring, or even analyzing.

Figure 7:
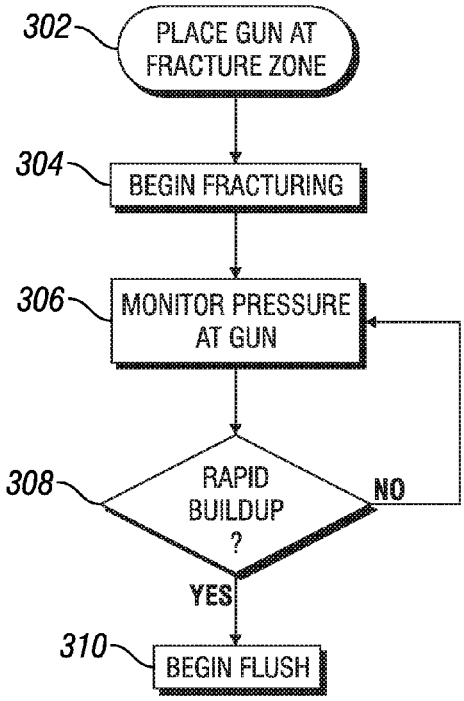
FIG. 7 shows a flowchart of a method of performing a hydraulic fracturing according to one embodiment of the present disclosure.

In one embodiment, the perforating gun sensor package 136 includes at least a pressure gauge 136A that transmits its reading through the wireline 108 to the monitoring and control computer 152. FIG. 7 is a flowchart that describes one embodiment of the present disclosure. Here, the perforating gun 135 is placed at 302 at the level of a fracture treatment zone 126 (e.g., 126A) prior to the initiation of hydraulic fracturing. Hydraulic fracturing is initiated at 304, and the pressure measurements from the pressure gauge 136A are sent at 306 to the monitoring and control computer 152, where an operator monitors the measurements. While at 308 the pressure remains steady, or increases only slowly, the operator continues to monitor at 306 the pressure from the pressure gauge 136A. When at 308, the operator sees a sudden buildup in the pressure measurement from the pressure gauge 136A, he initiates at 310 the flush of the wellbore 102. In one embodiment of the present disclosure, measurements from the pressure gauge 136A are monitored by plotting them on a Nolte-Smith plot 200. Here, when the slope of the logarithm of the net pressure 210 versus the logarithm of time 220 exceeds 1.0 260, the operator initiates the flush of the wellbore 102.

Because the pressure of the fracturing fluid is measured at the bottom of the wellbore, in the fracture zone, and not at the surface, the method herein described results in more accurate detection of tip screen-out. By more precisely detecting tip screen-out, both premature wellbore flushing, resulting in a less efficient well, and delayed wellbore flushing, resulting in wellbore screen-out, can be avoided.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about A to about B," or, equivalently, "from approximately A to B," or, equivalently, "from approximately A-B") disclosed herein is to be understood as referring to the power set (the set of all subsets) of the respective range of values. Accordingly, the protection sought herein is as set forth in the claims below.

We claim:

1. A method of operating a perforating gun system in a wellbore penetrating a subterranean formation, wherein the system comprises an array of perforating guns and a sensor package adjacent the array of perforating guns, the method comprising:

conveying the perforating gun system through the wellbore by wireline;

placing the perforating gun system proximate a treatment zone in the wellbore;

perforating the treatment zone;

introducing a proppant laden fluid from a surface to the treatment zone;

measuring at least one parameter in the wellbore with the sensor package while maintaining the perforating gun system in the proppant laden fluid;

transmitting though the wireline the measurement of the at least one parameter to a monitoring and controlling system;

adjusting at least one operational parameter of the perforating gun system in response to the transmitted measurement to achieve improved treatment efficiency and reservoir optimization, wherein the at least one operational parameter is selected from the group consisting of treatment fluid components, treatment fluid flow rate, treatment fluid pressure, treatment fluid properties, and any combination thereof; and, moving the perforating gun system.

2. The method of claim 1 wherein the sensor package comprises one or more of a pressure sensor, temperature sensor, pH sensor, or any combination thereof, and wherein the parameter is at least one or more of pressure, temperature, or pH.

3. The method of claim 1 wherein the treatment is hydraulic fracturing.

4. The method of claim 1 further comprising moving the perforating gun system, and repeating at least one of the placing, measuring, transmitting and adjusting steps.

5. The method of claim 1 wherein the parameter is pressure.

6. The method of claim 5 further comprising in response to the transmitted pressure:

detecting a sudden buildup in pressure in the wellbore at the location of the perforating gun system during the operation wherein a proppant is being pumped into a formation adjacent to the wellbore; and in response to the detection of a sudden buildup in pressure in the wellbore, commencing a flushing operation of the wellbore, thereby removing excess proppant from the wellbore and preventing the wellbore from filling with excess proppant.

7. The method of operating a perforating gun system of claim 5 wherein the sudden buildup of pressure that causes the flushing operation is such that, when the pressure measurement is plotted against time on a Nolte-Smith Plot, the slope of the pressure measurement exceeds one (1.0).

8. The method of operating a perforating gun system of claim 5 wherein the measuring at least one parameter, the transmitting the measurement of the at least one parameter to a monitoring and controlling system, and the adjusting operational parameters are conducted on a real time basis.

9. The method of claim 1 wherein the monitoring and controlling system comprises surface equipment to make the measurement transmitted readable by one or more of a computer or operator.

10. The method of claim 1 wherein the monitoring and controlling system comprises equipment to make the measurement transmitted readable by a computer located on in the wellbore.

11. The method of claim 1 wherein the monitoring and controlling system comprises equipment to make the measurement transmitted readable by one or more of a computer or operator, wherein the equipment is located in the wellbore and at the surface.

12. The method of claim 1 wherein the monitoring and controlling system comprises a data transmitting means, a computer, and a general user interface.

13. The method of claim 1 wherein the operational parameter is one or more of treatment fluid components, treatment fluid flow rate, treatment fluid pressure, or treatment fluid properties.

14. The method of operating a perforating gun system of claim 1 further comprising introducing a pad fluid and a proppant laden fluid into the wellbore.

15. The method of claim 14 wherein the fluids are injected at a pressure equal to or above the fracturing initiation pressure of the formation at the treatment zone.

16. The method of claim 14 wherein the fluids are at least partially injected prior to the measuring at least one parameter.

17. A method of fracturing a subterranean formation penetrated by a wellbore, the method comprising:

conveying a perforating gun system by wireline through the wellbore to a treatment zone wherein the system comprises an array of perforating guns and a sensor package adjacent the array of perforating guns;

perforating the treatment zone;

introducing a proppant laden fracturing fluid into the wellbore at a pressure sufficient to fracture the formation;

measuring at least one parameter in the wellbore with the sensor package while maintaining the perforating gun system in the proppant laden fracturing fluid;

transmitting though a wireline the measurement of the at least one parameter to a monitoring and controlling system;

adjusting at least one operational parameter of the perforating gun system in response to the transmitted measurement, wherein the at least one operational parameter is selected from the group consisting of treatment fluid components, treatment fluid flow rate, treatment fluid pressure, treatment fluid properties, and any combination thereof; and, moving the perforating gun system.

18. A method of treating a subterranean formation penetrated by a wellbore, the method comprising:

conveying a perforating gun system by wireline through the wellbore to a treatment zone wherein the system comprises an array of perforating guns and a sensor package adjacent the array of perforating guns;

positioning the perforating gun system in the wellbore;

measuring at least one parameter in the wellbore with the sensor package and transmitting though a wireline the at least one measured parameter;

adjusting on a real time basis at least one operational parameter in response to the measurement, wherein the at least one operational parameter is selected from the group consisting of treatment fluid components, treatment fluid flow rate, treatment fluid pressure, treatment fluid properties, and any combination thereof; and, moving the perforating gun system; and, performing at least one of the positioning, measuring, and adjusting steps prior to or after perforating the treatment zone and introducing a proppant laden fracturing fluid into the wellbore at a pressure sufficient to fracture the formation.

* * * * *